United States Patent [19]

Crisp et al.

[11] 4,436,196

[45] Mar. 13, 1984

[54] METHOD OF AND APPARATUS FOR ASSESSING COINS

[75] Inventors: Malcolm Crisp, Swavesey; Christopher Lewis, Ely, both of England

[73] Assignee: Plessey Overseas Limited, Ilford, England

[21] Appl. No.: 274,765

[22] Filed: Jun. 18, 1981

[30] Foreign Application Priority Data

Jun. 20, 1980 [GB] United Kingdom ..... 8020338

[51] Int. Cl.[3] ..... G07F 3/02

[52] U.S. Cl. ..... 194/100 A; 73/163

[58] Field of Search ..... 133/0.3 R, 0.8 R; 194/100 A, 100 R, 97 R, 99; 73/163; 324/228

[56] References Cited

U.S. PATENT DOCUMENTS

| | | | |
|---|---|---|---|
| 3,599,771 | 8/1971 | Hinterstocker | 194/100 A |
| 3,682,286 | 8/1972 | Prumm | 194/100 A |
| 3,797,307 | 3/1974 | Johnston | 194/100 A X |
| 3,901,368 | 8/1975 | Klinger | 194/100 A |
| 3,962,627 | 6/1976 | Ptacek et al. | 194/100 A |
| 4,254,857 | 3/1981 | Levasseur et al. | 194/100 A |
| 4,326,621 | 4/1982 | Davies | 194/100 A |
| 4,349,095 | 9/1982 | Lewis | 194/100 A |

FOREIGN PATENT DOCUMENTS

| | | |
|---|---|---|
| 1925042 | 11/1970 | Fed. Rep. of Germany . |
| 1930345 | 12/1970 | Fed. Rep. of Germany . |
| 2359468 | 2/1978 | France . |
| 1297499 | 11/1972 | United Kingdom . |
| 1523415 | 8/1978 | United Kingdom . |
| 2020469 | 11/1979 | United Kingdom . |
| 2027246 | 2/1980 | United Kingdom . |
| 1575365 | 9/1980 | United Kingdom . |
| 2056736 | 3/1981 | United Kingdom . |

*Primary Examiner*—Joseph J. Rolla
*Assistant Examiner*—Yogi Beyer
*Attorney, Agent, or Firm*—Fleit, Jacobson, Cohn & Price

[57] ABSTRACT

The invention relates to a coin validator for use in a micro-processor controlled call coin box telephone instrument. The validator comprises first and second coil sets driven by square wave interrogation pulses. The arrangement of the coils is such that when a coin is in the coin-runway of the call coin box, one coil pair is used to interrogate the coin in the runway while the other coil pair provides environmental conditions apertaining to the runway. The information generated by both coil sets is combined thereby compensating for environmental changes and drift. Information pertaining to the relative response times of the secondary coils is then used to determine coin validity.

6 Claims, 9 Drawing Figures

METHOD OF AND APPARATUS FOR ASSESSING COINS

Figure 1:
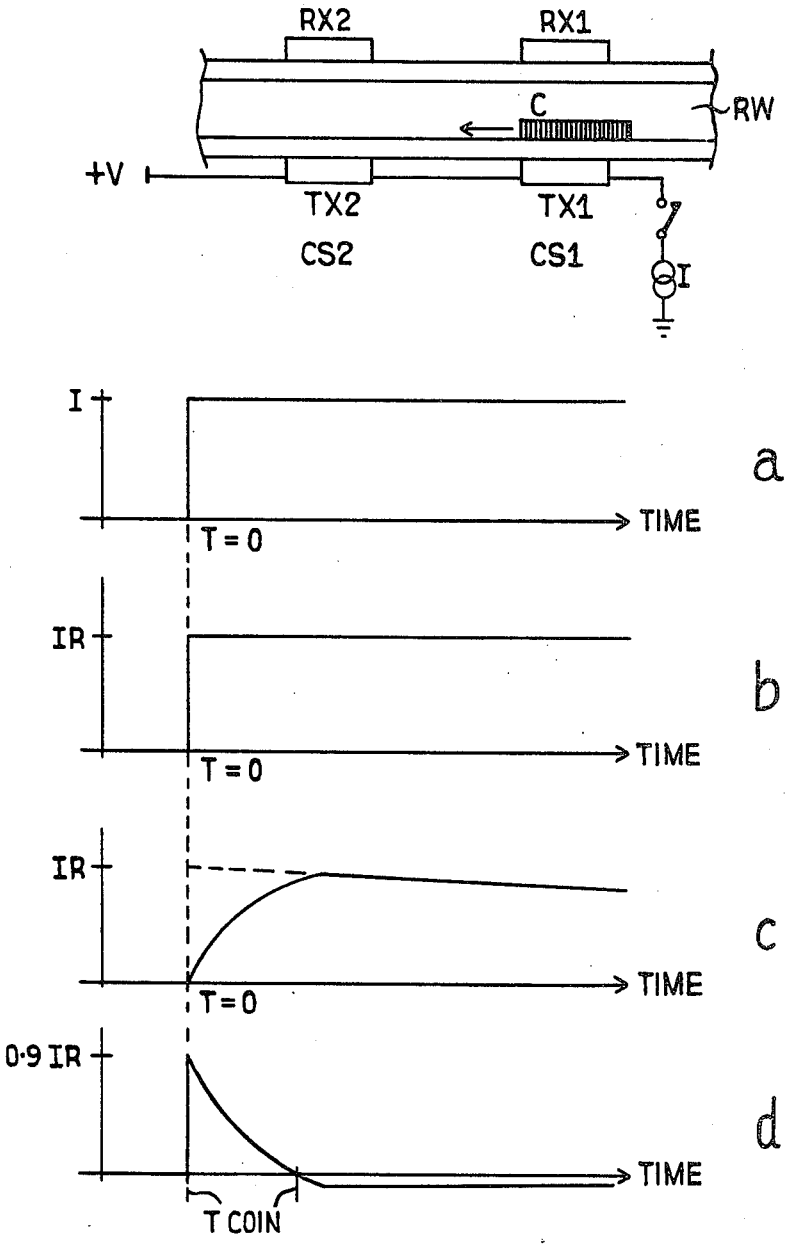

The present invention relates to a method of and apparatus for assessing coins for use in coin or token freed mechanisms and is more particularly although not exclusively concerned with coin validators suitable for use in coin operated telephone instruments or so-called payphones.

Numerous electronic coin validation arrangements have been produced in recent years all using differing techniques to produce parameters which can be checked against stored information indicative of the parameters for an authentic coin or token. These techniques can be separated into two major testing types, which may be used together to produce the composite parameters. Basically the major tests are those which generate information related to physical shape and size of the coin or token and those which generate information on the metal content of the coin or token.

One particular type of validator known in the prior art uses the basic effect of applying axially a step change of magnetic flux to the coin or token under test to induce an eddy current to flow in the periphery of the coin or token. Such an arrangement is disclosed in U.K . Patent Application No. 2,020,469. The coin or token acts like a coil comprising a single shorted turn and has an equivalent circuit comprising an inductance Lc, a resistance Rc and an emf generator in series. The coin resistance Rc is related to the resistivity of the coin and its resistance which the eddy current induced in the coin is also related to the current step in the transmit coil that produces the step change of magnetic flux and the mutual coupling Mc between the coil and the coin. The current induced in the receiving coil is used to provide an electronic signature of the coin under test, however, the current signature is dependent upon the coupling involving the transmit and receive coils which drifts due to temperature and environmental conditions.

It is an aim of the present invention to provide a method of assessing coins for use in a coin discriminator which includes automatic compensation for environmental changes and apparatus component value drift.

According to the invention there is provided a method of assessing coins comprising the steps of (i) passing a coin to be assessed along a coin runway which has associated therewith a pair of coil sets each coil set comprising a transmit coil and a receive coil, (ii) subjecting the coil sets to an abrupt flux change as the coin passes between the coils of at least one of the coil sets, (iii) combining the signals derived from the receive coils of both coil sets to produce a compensated signal corrected for environmental changes, and (iv) comparing the compensated signal with stored parameters for acceptable coins.

Also according to the invention there is provided an apparatus for assessing coins adapted to operate in accordance with the above method.

In one embodiment of the invention the two coil sets are mounted on the coin runway in such manner that a coin travelling along the runway travels through each coil set in succession and two tests are performed on the coin.

Figure 2:
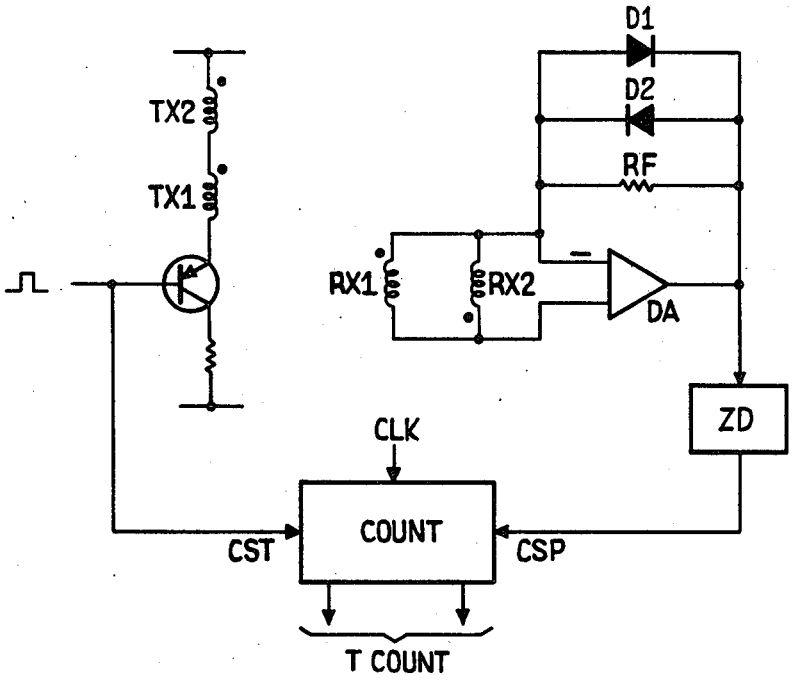
Figure 3:
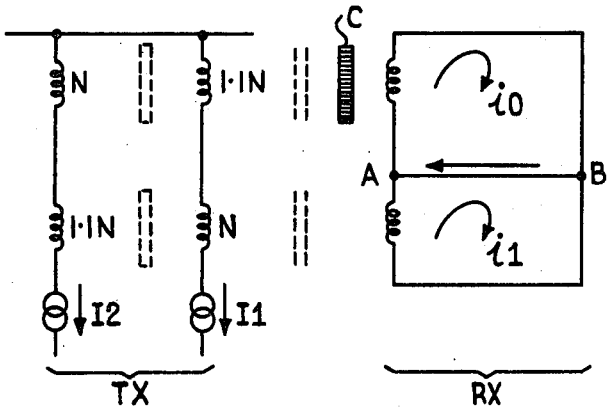
Figure 4:
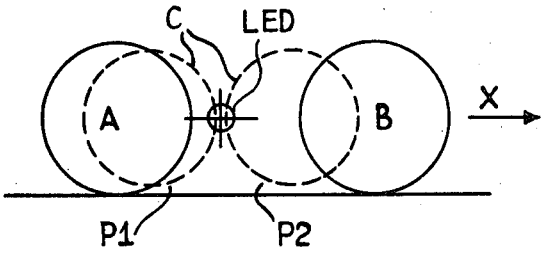
Figure 5:
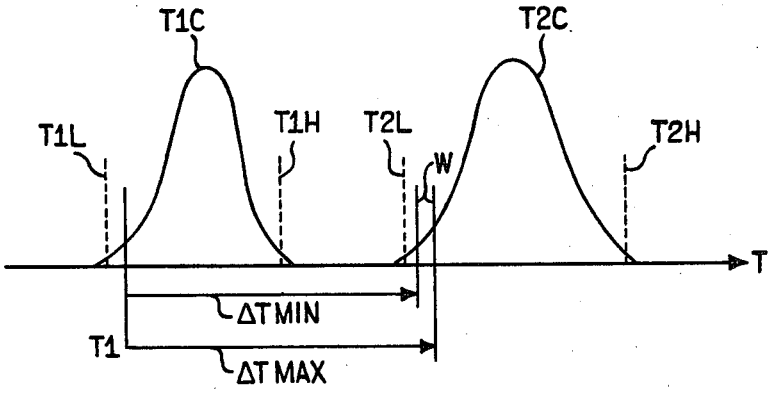

The invention will be more readily understood from the following description which should be read in conjunction with the accompanying drawings. Of the drawings:

FIGS. 1 and 1*a–d* show one embodiment of the invention with waveforms relevant thereto, FIG. 2 shows the subtraction arrangement for the two pulses produced by the embodiment of the invention, FIG. 3 shows in schematic form the operation of a two stage test, FIG. 4 shows the use of an opto detector to phase the operation of a two stage test while FIG. 5 shows probability distribution curves for the two values of T1 and T2 in a two stage test.

Considering firstly FIG. 1 it can be seen that the coin runway R is provided with two pairs of coin interrogating coil sets, CS1 and CS2.

The first coil set CS1, placed across the coin runway, FIG. 1 is used to apply a step change of magnetic field to the coin, and monitor the effect. The second coil set CS2 is used to provide a reference signal that compensates for temperature and drift in the measurement coils. With no coin present between the coils the waveform of FIG. 1*a* is produced in the receive coil. The receive coil current is measured by driving the coil into a summing junction on a differential amplifier DA as shown in FIG. 2. When the coin is present between the two coils, FIG. 1*b*, the rising edge of the receive coil current waveform is modified by the eddy current flowing in the coin. This produces a rising edge whose time constant is related to the coin type, by Lc and Rc. We can measure the rise time by using the reference current (FIG. 1*b*) and subtracting it from the coin present current (FIG. 1*c*) and then measuring the time from t=0 to when the waveform passes through zero shown as T coin in FIG. 1*d*. Typically for coinage in the United Kingdom T coin varies between 40$\mu$ seconds to 200$\mu$ seconds depending upon the coin value. It should be noted that the reference current is produced by a transmit coil with only 90% of the turns that are on the transmit coil that is testing the coin to ensure that the resultant compensated waveform (FIG. 1*d*) passes through zero. The summation circuit is shown in FIG. 2 using differential amplifier DA which includes a zero detection feed back arrangement provided by diodes D1 and D2 and resistors RF.

A second test may be made when the con is offset in relation to the second set of coils, see FIG. 4, now a certain amount of flux passes by the side of the coin and is directly linked into the receive coil, this produces a time period that is shorter than when the coin is placed centrally between the coils, and consequently, may give tighter acceptance criteria as two difference values of T coin are now available for the same coin. FIG. 3 shows in schematic form the two stage test. It should be noted that for the first test I1 is pulsed into the transmitter coils and that the coil adjacent the coin is 10% higher in turns. This sets the peak of i0 ten percent greater than i1 peak thereby ensuring that waveform d of FIG. 1 goes through zero. An assessment of the coin denomination is provided by measuring T coin as a result of apply I1.

When the coin reaches the second coil set, the test is re-applied using I2. The detection point for the application of the second test is determined by the use of a light emitting diode opto coupler LED in the coin runway as shown in FIG. 4, X being the direction of coin movement and A being the first coil set while B is the second coil set. It should be noted that when I2 is applied the ten percent turns differential is reversed to ensure that waveform d again goes through zero. Again the assessment of the coin denomination is provided by measuring T coin as a result of applying I2. Further it will be appreciated that the positioning of the LED in the runway (FIG. 4) relative to the location of the coil sets allows the two tests to be performed with differing coin positions. Obviously the values of T coin for each test will now differ for the same coin and it has been found that the values of T coin 1 and T coin 2 for differing coins of the same denomination have gaussian distributions and the location of T coin 1 in the first distribution correlates to the location of T coin 2 in the second distribution. Hence Δt (=T coin 2−T coin 1) has a narrower distribution.

The FIG. 1*d* waveform can be converted into a T coin value using a digital counter COUNT in FIG. 2 which is switched on at the start of the test by lead CST and is switched off by lead CSP when the output from the differential amplifier DA reaches zero as detected by a zero detector ZD. The accuracy of this arrangement of course depends upon the clock rate chosen for the clock pulses CLK. This arrangement is used for each test and therefore produces successive values of T1 and T2. These values are then assessed by a microprocessor to check to see if the coin falls within acceptance parameters. The counter is arranged to be reset to zero after the results of each test and typically the reset would be under the control of a micro-processor generated reset signal.

The times T1 and T2 obtained for any given coin differ because the second test is carried out when the coin is in a slightly different position (relative to the test coils) to that of the first test.

Acceptable coins of a given denomination give rise to probability distribution curves for the T1 and T2 measurements as shown in FIG. 5. It has been found that any given coin produces T1 and T2 measurements at approximately corresponding points in the two distribution curves. Also there are different T1 distribution curves for the different coin denominations, and different corresponding T2 curves.

In response to the first test, the measured value T1 is compared with stored limit values of T1low and T1high for the different acceptable denominations, in order to determine tentatively the denomination of the coin. Having made this tentative determination, T2 of the second test will be expected to lie within a window W. Thus, after measuring T1 and tentatively identifying the coin, (T1+ΔTmin) is formed, and (T1+ΔTmax) is also formed, ΔTmin and ΔTmax being stored reference values for the denomination of coin tentatively identified. Then the measured value T2 is compared to check that it satisfies the condition:

$$(T1+\Delta Tmin)<T2<(T1+\Delta Tmax) \quad (1)$$

Also, a further safeguard is carried out by checking that T2 satisfies the condition:

$$T2low<T2<T2high \quad (2)$$

where T2low and T2high are reference values also stored for each acceptable denomination.

As mentioned previously the system incorporates a micro-computer and this is arranged to have a memory which stores the reference values T1low, T1high, ΔTmin, ΔTmax and T2low, T2high for each allowable denomination, the micro-computer being programmed to carry out the necessary comparisions defined above by inspecting the count values stored in the counter COUNT of FIG. 2 after each test.

The above description has been of one embodiment only and is not intended to be limiting to the scope of the invention. Alternative arrangements will readily be seen by those skilled in the art for example the two coil sets have been shown mounted in the runway, however, one coil set only could be located in the runway, with the other set used exclusively for reference purposes. The disclosure has also made reference to coins, however, it will be appreciated that such a term is intended also to include tokens.

What we claim is:

1. A coin discriminating apparatus comprising first and second coil sets each comprising a transmit and receive coil, each set arranged to be subject to an abrupt flux change and associated with a coin runway in such a manner that a coin passing along the runway travels through a coil set and the transmit coils of both coil sets are driven in series by an abrupt flux change generator which is operable as the coin passes the said coil set, and the receive coils of the coil sets are connected in parallel and in opposition to each other and across the inputs of a differential amplifier whose output is used to drive a zero detector, the composite waveform produced being indicative of the coin passing the coils and the apparatus includes means for comparing the composite waveform with stored information indicative of acceptable coins.

2. A coin discriminating apparatus according to claim 1, in which each coin as it passes down the runway operates means for performing two separate test operations and the results of the first test are used to extract from the stored information window parameters indicative of the coin defined by the results of the first test and the results of the second test are compared with the window parameters.

3. A coin discriminating apparatus according to claim 2, in which the two coil sets are mounted adjacent to the coin runway in such manner that a coin passing along the runway passes between the transmit and receive coils of each set in succession and the first test is performed with the coin adjacent the first set of coils and the second test is performed with the coin adjacent the second set of coils.

4. A coin discriminating apparatus as claimed in claim 1, in which the receive coils of the pairs are connected in parallel and in opposition to each other and across the inputs of a differential amplifier whose output is used to drive a zero detector.

5. A coin discriminating apparatus as claimed in claim 4, in which the output of the zero detector is used to stop a counter which is arranged to be driven by a source of clock pulses enabled by the leading edge of a pulse produced by the abrupt change generator.

6. A coin discriminating apparatus as claimed in claim 5, in which the output of the counter is used to define the information indicative of the result of the first and second tests.

* * * * *